United States Patent [19]

Herborn

[11] 4,243,310

[45] Jan. 6, 1981

[54] HIGH SPEED, LOW TEMPERATURE DIAZO PROCESSOR

[75] Inventor: Peter E. Herborn, Menlo Park, Calif.

[73] Assignee: Quantor Corporation, Mountain View, Calif.

[21] Appl. No.: 31,695

[22] Filed: Apr. 19, 1979

[51] Int. Cl.[3] ..... G03D 7/00

[52] U.S. Cl. ..... 354/299; 354/300; 430/150; 34/37; 34/234

[58] Field of Search ..... 354/297, 299, 300; 355/27, 100, 106; 96/49; 34/36, 37, 155, 234; 55/70; 430/150

[56] References Cited

U.S. PATENT DOCUMENTS

| | | | |
|---|---|---|---|
| 2,009,962 | 7/1935 | Kurten | 354/300 |
| 2,761,364 | 9/1956 | Cross | 34/234 |
| 3,147,687 | 9/1964 | Halden | 354/300 |
| 3,364,833 | 1/1968 | Mulvany | 354/300 |
| 3,411,906 | 11/1968 | Boone et al. | 96/49 |
| 3,435,751 | 4/1969 | Goodman et al. | 354/297 |
| 4,056,824 | 11/1977 | Iiyama et al. | 354/300 |
| 4,099,868 | 7/1978 | Schroter et al. | 355/106 |
| 4,122,473 | 10/1978 | Ernohazy et al. | 354/299 |
| 4,135,814 | 1/1979 | Schroter et al. | 96/49 |
| 4,150,992 | 4/1979 | Meadows et al. | 354/300 |

FOREIGN PATENT DOCUMENTS

| | | | |
|---|---|---|---|
| 2656901 | 3/1977 | Fed. Rep. of Germany | 354/300 |
| 2659485 | 3/1978 | Fed. Rep. of Germany | 354/300 |

*Primary Examiner*—L. T. Hix
*Assistant Examiner*—Alan Mathews
*Attorney, Agent, or Firm*—J. T. Cavender; Wilbert Hawk, Jr.; George J. Muckenthaler

[57] ABSTRACT

A processor for developing diazo film has flat platens disposed within a housing and spaced apart a distance to accommodate the thickness of the film. The housing includes an inlet and an outlet aligned with the space between the platens and means for advancing a film from the inlet and through the space between the platens in a preheat chamber and in a developing chamber and for discharging the developed film. The platen facing the emulsion side of the film is heated in the preheat chamber so that the film is heated to a desired temperature prior to developing. A metered amount of aqueous ammonia is supplied through a lower chamber at the inlet end of the developing chamber wherein the ammonia is separated from the water by reason of the differential temperature and ammonia vapor rises to contact the emulsion side of the film for rapidly developing thereof and the water is drained from the lower chamber.

14 Claims, 4 Drawing Figures

HIGH SPEED, LOW TEMPERATURE DIAZO PROCESSOR

BACKGROUND OF THE INVENTION

Diazo sensitized papers have been used for making duplicate copies from originals by means of contact printing and development of the exposed diazo paper in an aqueous ammonia vapor atmosphere. Diazo sensitized films have been used as a medium for making microfilm or microfiche masters and duplicates thereof because of the low cost, the high resolution and the increased speed of operation. Increasing demands are made on the film developing process, especially as to the speed of developing so as to enable an efficient and high volume production of diazo film copies from a master.

In some of the prior methods and apparatus which have been utilized for developing diazo film, it has been thought necessary that the development take place at higher pressure and higher temperature conditions as represented by prior knowledge of the design of previous processors of this type.

Representative prior art which is directed to film processing includes U.S. Pat. No. 2,009,962 issued to W. Kurten on July 30, 1935; U.S. Pat. No. 3,147,687 issued to J. G. B. Halden on Sept. 8, 1964; U.S. Pat. No. 3,364,833 issued to R. B. Mulvaney on Jan. 23, 1968; U.S. Pat. No. 3,411,906 issued to J. W. Boone et al. on Nov. 19, 1968; U.S. Pat. No. 3,435,751 issued to R. C. Goodman et al. on Apr. 1, 1969; and U.S. Pat. No. 4,056,824 issued to K. Iiyama et al. on Nov. 1, 1977.

Additionally, U.S. Ser. No. 862,720 filed Dec. 27, 1977 on the application of J. W. Meadows et al. now U.S. Pat. No. 4,150,992 Apr. 24, 1979 discloses a high-speed low-temperature and pressure diazo film processing method. Further, U.S. Ser. No. 897,081 filed Apr. 17, 1978 as a continuation-in-part application of J. W. Meadows et al. discloses a high-speed low-temperature and pressure diazo film processing apparatus. Both of the above-identified applications are assigned to the same assignee as the present invention.

The above applications disclose processing method and apparatus which include a number of advantageous features, however, it is desirable to operate the processor at temperatures which are lower than are required for certain types of film and additionally it is desirable that the injection method for introducing the aqueous ammonia into the atmosphere and vicinity of the developing chamber be such as to precisely and completely develop the film without defects or moisture spots on the film which may interfere with reading of the data which is on the film.

SUMMARY OF THE INVENTION

The present invention is related to film duplicators and, more particularly, to a diazo film developing processor for compact, efficient and easy-to-operate apparatus at high volume film output. The processor is a high-speed, low temperature, zero pressure, and low aqueous ammonia consumption diazo processing apparatus wherein the diazo film passes through the processor and is developed in a heated ammonia vapor environment. The film is developed in ammonia vapor at a pressure which does not substantially exceed atmospheric pressure in that the pressure may be only slightly higher than atmospheric pressure by an amount no more than that required to introduce the vapor into the developing chamber. The low pressure ammonia vapor is combined with a relatively low range of operating temperatures which in the preferred embodiment are between 170° F. and 190° F. in a manner to lower the cost of heating the particular parts and to avoid damage to the film as it passes through the developing chamber.

The diazo film is caused to be moved into a pre-heat chamber to condition the film emulsion and the film is then transferred into a developing chamber which includes a cavity or trough portion at the entrance side of the developing chamber for carrying the ammonia vapor to the underside of the film. The aqueous or water-containing ammonia is introduced into the cavity portion of the developing chamber at a temperature which may be slightly above ambient temperature and the ammonia is caused to be vaporized by the difference in temperature between the entering ammonia and the temperature of the atmosphere surrounding the elements which carry the film through the developing chamber. The ammonia is separated from the water in the cavity portion and the water is drained off in suitable manner.

In accordance with the above discussion, the principal object of the present invention is to provide a high speed film processing system wherein the film is rapidly and uniformly developed within a few seconds.

An additional object of the present invention is to provide a film developing system for operation at lower temperatures to enable development of different types and/or kinds of diazo film.

Another object of the present invention is to provide a film developing system which includes distribution of the required heat from a heater element which is disposed to provide the proper heated ammonia vapor environment.

A further object of the present invention is to provide a water-ammonia separation chamber and to enable a temperature differential between the incoming aqueous ammonia and the vaporized ammonia for developing the film.

Additional advantages and features of the present invention will become apparent and fully understood from a reading of the following specification taken together with the annexed drawing.

DESCRIPTION OF THE PREFERRED EMBODIMENT

Figure 1:
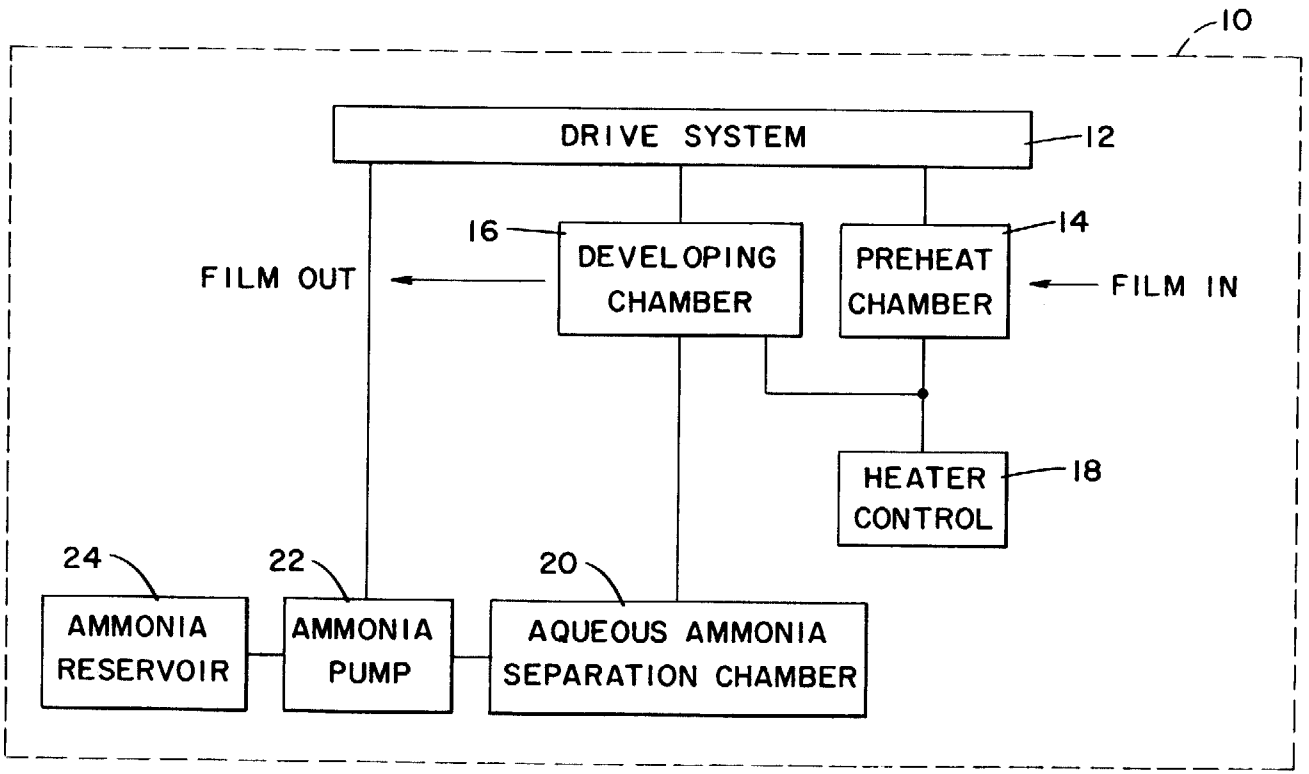
FIG. 1 is a block diagram of the major parts of the film processing system.

Referring now to the drawing, the processor of the present invention comprises a plurality of major parts as shown in FIG. 1 and wherein the enclosure structure 10 and the various major parts of the processor are shown in block form representing the diazo film developing system. The major parts of the processor include a drive system 12 associated with a preheat chamber 14 and a developing chamber 16, which chambers are in communication with a heater control 18 for the purpose of providing the desired temperatures in the respective chambers. The drive system 12 is also in communication with an ammonia pump 22 which receives ammonia from a reservoir 24 and conveys the ammonia in aqueous form into a separation chamber 20.

Figure 2:
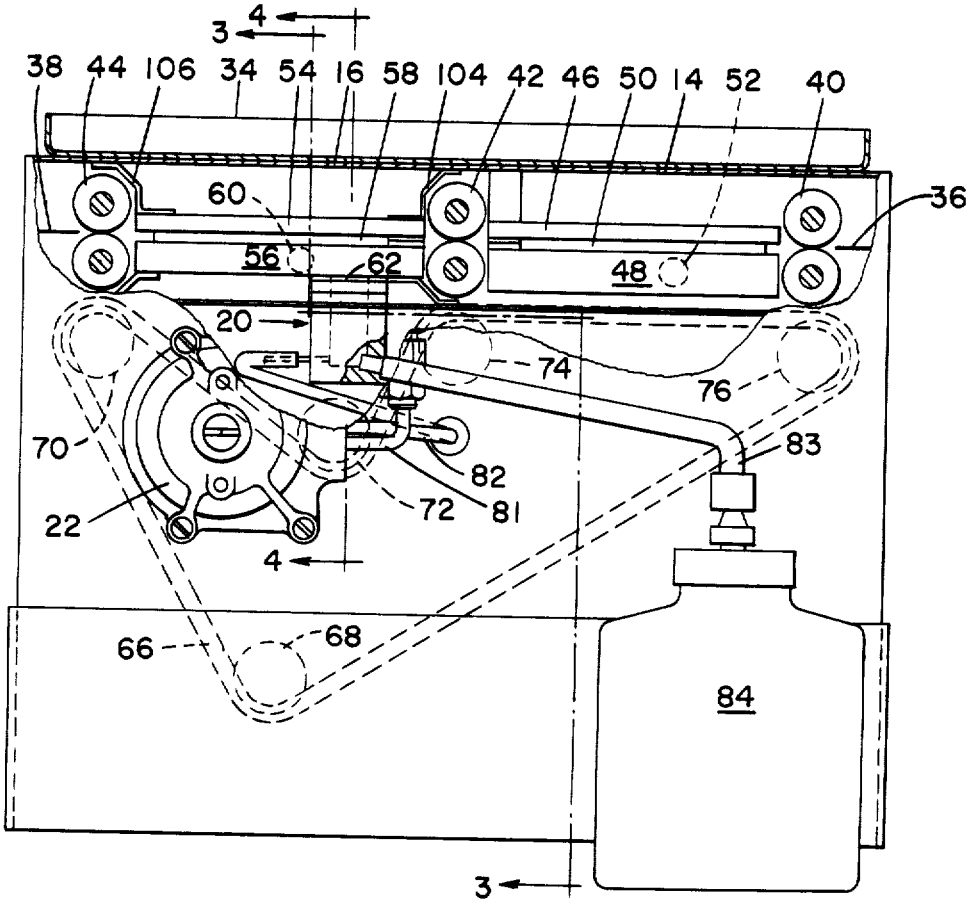
FIG. 2 is a front elevational view, partially in section, of a processor incorporating the subject matter of the present invention.
Figure 3:
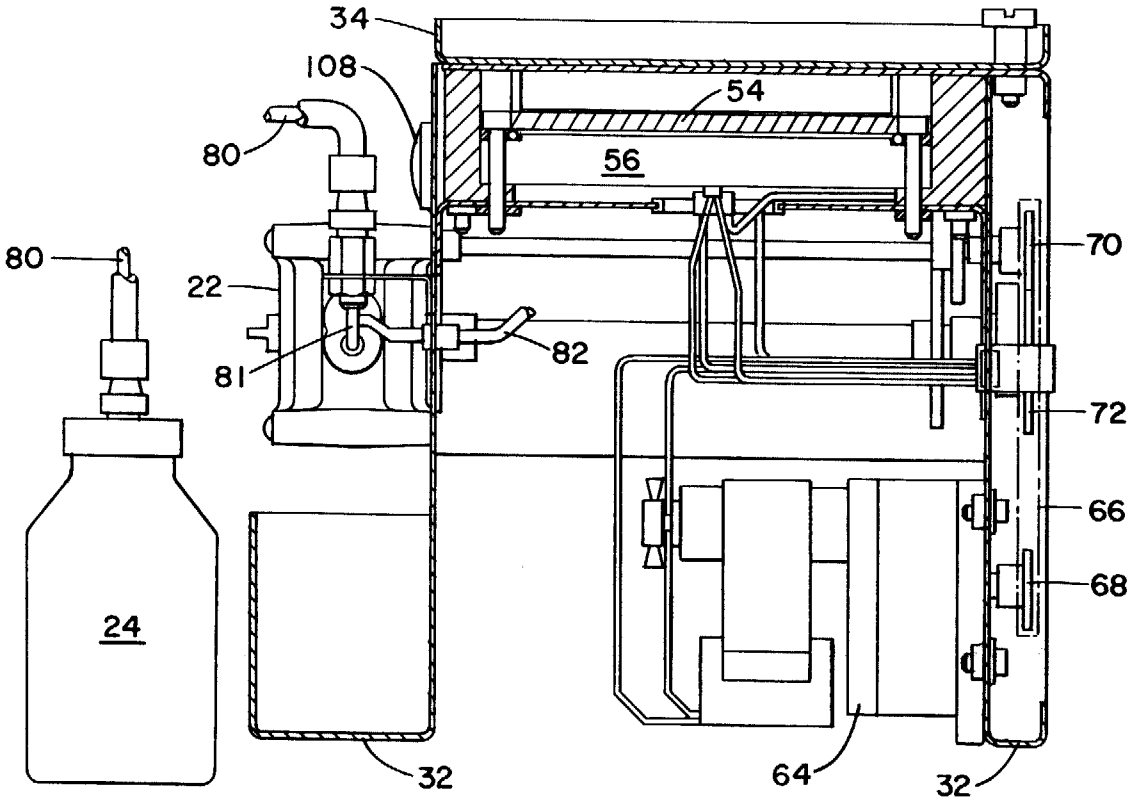
FIG. 3 is a side elevational view, partially in section, taken on the plane 3—3 of FIG. 2.

In FIG. 2 is shown a front elevational view of the processor and in FIG. 3 is shown a partial sectional and side elevational view thereof with certain of the parts being placed for accommodation on the drawing. A base assembly 32 provides support for the various parts of the processor and a cover assembly 34 is secured to the top of the unit in suitable manner. A portion of a diazo film 36 is shown entering at the right side in FIG. 2 and a portion of the film 38, after developing thereof, is shown leaving at the left side. The diazo film 36 is caused to be moved in a path between a pair of rollers 40 into and through the preheat chamber 14 and further caused to be moved by a pair of rollers 42 into and through the developing chamber 16 and finally, a pair of rollers 44 convey the developed film 38 from the processing unit.

The preheat chamber 14 includes an upper plate 46 and a lower plate or block 48 which are spaced apart by means of a spacer 50 on each side of the film path a distance sufficiently to enable passage of the film 36 as it is moved from the right to the left in FIG. 2. A heater 52 in the form of a rod is embedded in the lower plate 48 for heating thereof and of the upper plate 46 through the spacers 50 for the purpose of preconditioning the emulsion on the film. The developing chamber 16 includes an upper plate 54 and a lower plate or block 56 which are likewise spaced from each other by means of a spacer 58, one of which is positioned on either side of the path of the film 36. A heater 60 and a thermal resistor 62 are associated with the developing chamber 16 so as to maintain a desired temperature in the developing chamber 16 and also to control the amount of heat to the aqueous ammonia separation chamber 20. A suitable thermometer (shown in FIG. 4) is preferably located at the front of the developing chamber 16 for viewing the temperature therein.

A motor 64, shown in FIG. 3, is provided to drive the various pairs of rollers by means of a drive chain 66 trained around a series of pulleys 68, 70, 72, 75 and 76, as seen in FIG. 2, for driving or traveling in a clockwise direction so as to cause the diazo film 36 to be moved from right to left. The drive system also accommodates the pump 22 to cause the pump to move the aqueous ammonia from the reservoir 24 through a bulkhead fitting by means of a tubing 80 and from the fitting by a tubing 81 to the pump. The ammonia is moved from the pump 22 to the separation chamber 20 through a tubing 82 extending into one side of the chamber 20. A tube 83 has one end thereof disposed for draining the separation chamber 20 of accumulated water and to deposit such water into a container or bottle 84.

Figure 4:
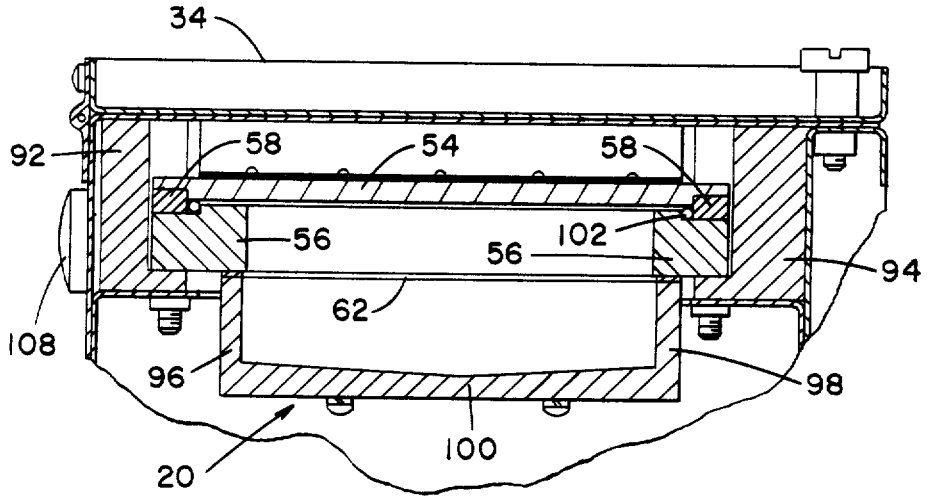
FIG. 4 is an enlarged sectional view taken on the plane 4—4 of FIG. 2.

In FIG. 4 is shown a sectional view through the developing chamber 16 and through the separation chamber 20 which is located at the entrance end of the developing chamber and is in the shape of a deep cavity or trough to accommodate the temperature differential between the aqueous ammonia being introduced into the lower chamber 20 and the upper part of the developing chamber 16. The developing chamber 16 includes the side walls 92 and 94 which are covered by the cover assembly 34 so as to provide a closed container for the developing portion of the processor. The separation chamber 20 includes the side or end walls 96 and 98 and a lower base 100 and which forms an elongated cavity at the entrance end of the developing chamber 16 for enabling the vaporized ammonia to rise and thereby make contact with the emulsion side of the diazo film 36. An edge seal 102 in the form of an O-ring is placed adjacent the spacers 58 and between the upper plate 54 and the lower plate 56 of the developing chamber 16 to arrest the ammonia fumes or vapors and prevent escape thereof into the surrounding atmosphere. Additionally, seals 104 and 106 are provided adjacent the pair of rollers 42 and rollers 44 to contain the ammonia vapor or fumes within the chamber 16. The thermometer, mentioned earlier, as shown as 108, is on the left side in FIG. 4 with its probe extending about midway through the lower plate 56.

In the operation of the processor, the diazo film 36, in an exposed and cut-to-length condition and with the emulsion side of the film disposed in a downward direction, is caused to be moved by rollers 40 into the preheating chamber 14 wherein the emulsion on the film is preconditioned by the elevated temperature through heating the plate 48 by use of the heater 52 and which heat is caused to be moved by thermal conduction through the spacers 50 and to the upper plate 46. The second pair of pinch rollers 42 then transport the conditioned film 36 into the developing chamber 16 where the emulsion on the lower side of the film is exposed to and contacted by the ammonia vapors which react with the emulsion and thereby develop the film. The third pair of rollers 44 then convey the developed film 38 from the chamber 16 and onto a tray (not shown) on the side of the processor. In similar manner, as in the case of the first chamber 14, the heater 60 provides the desired heat in the developing chamber 16 to the elevated temperature in heating the lower plate 56 and through the spacers 58 to also heat the upper plate 54. The aluminum plates 46, 48 in the preheat chamber 14 and also the aluminum plates 54, 56 in the developing chamber 16, along with the aluminum spacers 50, 58 between the plates distribute the heat by thermal conduction and the aluminum plates in each of the chambers are coated with suitable thermoplastic material on the surfaces which are adjacent the film path.

The aqueous or watery ammonia is introduced into the separation chamber 20 and with a certain amount of heat being transferred from the plate 56 through the thermal resistor 62 and to the walls of the separation chamber 20, the separation chamber is caused to be heated a desired amount which is substantially lower than the temperature of the upper chamber. The thermal resistor 62 is a controlling factor in determining the desired temperature differential between the two chambers 16 and 20 and is made of stainless steel to provide and maintain a temperature differential between the two chambers. As the aqueous ammonia is caused to be introduced at substantially ambient temperature into the separation chamber 20, which chamber is at a temperature slightly above the ambient temperature, the ammonia separates from the water in extremely fast or rapid manner and the ammonia vapor spreads rapidly and rises by reason of the elevated temperature of the developing chamber 16. The higher temperature environment at the top of the separating chamber 20 is saturated with ammonia vapor in a uniform manner so that when the film passes across the open chamber 20 the contact with the emulsion causes development of the film within a period of one to two seconds. The water is accumulated and drains off after the ammonia has separated and because the water is only in the cooler portion of the chamber 20, the water does not enter and does not appear on surfaces in the developing chamber 16. Summarily, when the aqueous ammonia is injected or introduced into the separation chamber or trough 20 below the film developing area, the ammonia separates from the water and the ammonia vapors rise with the warm air to contact the preheated emulsion on the underside of the diazo film 36 for developing thereof as the film passes over the open chamber 20. In this manner the water is prevented from contacting the film and thus the film is free of water spots.

In actual operation, it was seen that the optimum temperature in the developing chamber 16 was about 180° F. and that an 18 tooth sprocket in the ammonia pump 22 provided the correct amount of ammonia vapor for superior development of the film and thereby consuming a minimum amount of aqueous ammonia. The thermal resistor or spacer 62 is made of 18 gauge stainless steel which proved in the final design to uniformly control the heat flow from the lower plate 56 in the developing chamber 16 to the separation chamber 20 so as to provide the optimum temperature differential between the developing area 16 and the bottom of the trough 20. When the thermometer 108 read 180° F. (82.2° C.), typical observed temperatures of the upper plate 54, the lower plate 56, and the bottom of the trough 20 were 80.2°-80.4° C., 82.4°-84.8° C., and 81.4°-82.0° C., respectively, to provide a temperature differential of 1°-2.8° C. between the lower plate and the bottom of the trough with a desired figure of 3°-5° F. for proper separation of the ammonia and water.

It is thus seen that herein shown and described is a diazo film developing system, method and apparatus for developing diazo film in a high speed, low temperature, substantially zero pressure, and low aqueous ammonia consumption processor which is extremely reliable and efficient for developing the diazo film. The present invention enables the accomplishment of the objects and advantages mentioned above, and while a preferred embodiment of the invention has been disclosed herein, variations thereof may occur to those skilled in the art. It is contemplated that all such variations and modifications not departing from the spirit and scope of the invention hereof are to be construed in accordance with the following claims.

What is claimed is:

1. A diazo film developing system comprising a first chamber for preheating said film, a second chamber for developing said preheated film, means for heating said second chamber, means for moving said film through said first and said second chambers, means defining a cavity adjacent said second chamber for receiving aqueous ammonia in controlled manner, and thermal control means comprising a heat resistant spacer element connecting said second chamber and said cavity for maintaining a temperature differential therebetween, said cavity means having a temperature lower than the temperature of said second chamber whereby said aqueous ammonia is vaporized and the ammonia vapor contacts the emulsion of said film, the temperature differential causing the ammonia to separate from the water prior to contact with said film.

2. The system of claim 1 wherein said first chamber includes a pair of spaced surfaces defining a path for the diazo film and a heating element for heating said surfaces.

3. The system of claim 1 wherein said second chamber includes a pair of spaced surfaces defining a path for the diazo film and a heating element for heating said surfaces and wherein said thermal control means comprises a plate element engaging one of said surfaces and in contact with an edge of said cavity means for controlling the flow of heat thereto.

4. The system of claim 1 wherein said cavity means comprises a recessed portion of said second chamber disposed at one end thereof for conveying the ammonia vapor to the film.

5. The system of claim 1 wherein said cavity means comprises a recessed portion of said second chamber disposed at one end thereof and wherein said thermal control means comprises a plate element engaging one of said surfaces and in contact with an edge of said cavity means to provide the temperature differential for separating ammonia from water, the water being drained from said recessed portion.

6. A method for developing diazo film having an emulsion on one side thereof, comprising the steps of:

providing a developing chamber for passage of said film therethrough, heating the atmosphere of said chamber to a predetermined temperature, introducing aqueous ammonia into a lower portion of said chamber at a temperature lower than said predetermined temperature, and placing a heat resistant spacer element between said developing chamber and said lower portion of said chamber for maintaining temperature differential therebetween for enabling said aqueous ammonia to be separated from the water and wherein the vaporized ammonia contacts the emulsion of said film.

7. The method of claim 6 including the step of preheating the film prior to entrance thereof into said developing chamber.

8. The method of claim 6 wherein the step of introducing aqueous ammonia comprises a continuous flow of ammonia into said lower portion of said chamber.

9. Apparatus for developing diazo film comprising:

means defining a heated developing chamber and including first and second, spaced-apart, substantially parallel surfaces to provide a path for said diazo film, and a cavity portion at one end of said developing chamber, means for moving said diazo film into and through said developing chamber with the emulsion side of said diazo film adjacent one of said surfaces, means for introducing aqueous ammonia into the cavity portion of said developing chamber, and thermal control means comprising a heat resistant spacer element connected with one of said surfaces and with said cavity portion for controlling the temperature therebetween, the temperature of said cavity portion being lower than the temperature of the film path through said developing chamber to enable vaporization of said aqueous ammonia whereby ammonia vapor is separated from the water and the vapor contacts the emulsion side of said diazo film.

10. The apparatus of claim 9 including means for preheating the diazo film to a desired temperature prior to entering the developing chamber.

11. The apparatus of claim 9 wherein said film moving means comprise a pair of cooperating rollers at each end of the developing chamber.

12. The apparatus of claim 9 wherein said cavity portion comprises a separate chamber disposed at one end of said developing chamber and open across the top for communication with the emulsion side of said diazo film.

13. The apparatus of claim 9 wherein said aqueous ammonia introducing means includes a pump for conveying a continuous flow of aqueous ammonia into the cavity portion of said developing chamber at approximately ambient temperature.

14. The apparatus of claim 9 including means for preheating the diazo film to a desired temperature and means for heating one of said surfaces of said developing chamber for providing a temperature differential between the cavity portion and the developing chamber whereby ammonia vapor is separated from the water and contacts the emulsion side of said diazo film.

* * * * *